US011028506B2

(12) United States Patent
Alexander et al.

(10) Patent No.: US 11,028,506 B2
(45) Date of Patent: Jun. 8, 2021

(54) ACTIVE TEXTILE STRUCTURES WITH SELECTIVELY VARIABLE SURFACE FRICTION CHARACTERISTICS

(71) Applicant: GM Global Technology Operations LLC, Detroit, MI (US)

(72) Inventors: Paul W. Alexander, Ypsilanti, MI (US); Nancy L. Johnson, Northville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 646 days.

(21) Appl. No.: 15/854,207

(22) Filed: Dec. 26, 2017

(65) Prior Publication Data

US 2019/0194840 A1 Jun. 27, 2019

(51) Int. Cl.

| | |
|---|---|
| ***D03D 15/10*** | (2006.01) |
| ***D03D 1/00*** | (2006.01) |
| ***D03D 15/58*** | (2021.01) |
| ***D04B 1/14*** | (2006.01) |

(52) U.S. Cl.

CPC ..... *D03D 15/58* (2021.01); *D03D 1/00* (2013.01); *D03D 1/0088* (2013.01); *D04B 1/14* (2013.01); *D03D 2700/0166* (2013.01); *D10B 2401/00* (2013.01); *D10B 2401/16* (2013.01); *D10B 2401/18* (2013.01); *D10B 2403/01* (2013.01); *D10B 2505/08* (2013.01); *D10B 2505/12* (2013.01)

(58) Field of Classification Search

None

See application file for complete search history.

(56) References Cited

U.S. PATENT DOCUMENTS

| | | | |
|---|---|---|---|
| 5,858,159 | A | 1/1999 | Holbrook et al. |
| 6,350,709 | B1 | 2/2002 | Veiga |
| 6,808,587 | B2 | 10/2004 | Bohm et al. |
| 8,550,222 | B2 | 10/2013 | Browne et al. |
| 2006/0186700 | A1 | 8/2006 | Browne et al. |
| 2010/0129575 | A1 | 5/2010 | Veiga |

(Continued)

FOREIGN PATENT DOCUMENTS

WO WO2017165435 * 9/2017

*Primary Examiner* — Shawn Mckinnon

(74) *Attorney, Agent, or Firm* — Quinn IP Law

(57) ABSTRACT

Presented herein are active textile structures with selectively variable surface friction characteristics, methods for making/using such structures, and vehicle components fabricated with electronically controlled textile structures with modifiable surface friction characteristics. An active textile system for governing frictional force levels at an interface with a user or object is presented. The system includes a textile structure that is fabricated from interlaced first and second textile filaments. Each textile filament has a respective texture that exhibits a distinct coefficient of friction. The textile structure has an outer and/or upper contact surface at the interface with the user/object. An actuating element, which is connected to the textile structure, is operable to selectively transition the textile structure between first and second states. The first state includes the first textile filament defining the textile structure's outer contact surface, whereas the second state includes the second textile filament defining the outer contact surface.

20 Claims, 2 Drawing Sheets

(56) References Cited

U.S. PATENT DOCUMENTS

| | | | |
|---|---|---|---|
| 2011/0062134 | A1 | 3/2011 | Lochtman et al. |
| 2012/0280479 | A1 | 11/2012 | Barth et al. |
| 2016/0303799 | A1 | 10/2016 | Pettey et al. |

* cited by examiner

ACTIVE TEXTILE STRUCTURES WITH SELECTIVELY VARIABLE SURFACE FRICTION CHARACTERISTICS

INTRODUCTION

The present disclosure relates generally to natural, synthetic, and multi-material textile structures. More specifically, aspects of this disclosure relate to multi-material textile structures with variable surface friction characteristics.

Current production motor vehicles, such as the modern-day automobile, are originally equipped with various assemblies and components comprised of elements that are manufactured, in whole or in part, from textile materials. A vehicle seat assembly, for example, is composed of a generally upright seatback and a generally horizontal seat bottom, both of which are functionally supported on a seat platform that mounts to the vehicle body. Standard seatback and seat bottom sections include a rigid metallic or polymeric frame with an optional spring-based suspension, an expandable foam cushion that is supported on the frame, and a leather or textile seat trim material covering the frame and cushion. Other vehicle components and assemblies that may be fabricated with textile features include, but are certainly not limited to, interior trim panels, floor panels and mats, knee bolsters, roof reinforcement panels, center stack consoles, center tunnel armrest consoles, instrument panel (IP) fascia, rear deck covers, etc.

In addition to covering and protecting the cushion, frame, and other internal seat componentry, the seat trim material provides an exterior contact surface that interfaces with an occupant of the vehicle seat assembly. For some vehicle seat designs, the seat cushions are made from an expandable foam material that is molded to a predetermined shape and thickness, e.g., to provide desired ergonomic and stiffness characteristics. The combined configuration of the trim material, cushion, and suspension determine the contact area of the vehicle seat occupant, as well as the pressure distribution of contact pressure experienced by the seated occupant. The comfort of a seated occupant is often affected by the area and pattern of the occupant's contact with the seat bottom and seatback surfaces, and by the maximum contact pressure and pressure distribution of the contact pressure experienced by the seated occupant. The comfort of a seated occupant may further be affected by the thermal characteristics and the surface friction characteristics of the seat trim material.

SUMMARY

Disclosed herein are active textile structures with selectively variable surface friction characteristics, methods for making and methods for using such active textile structures, and motor vehicles with a vehicle component or assembly having features fabricated from electronically controlled textile structures with modifiable surface texture and friction characteristics. By way of example, there is presented a textile structure fabricated from a multi-material, pretensioned yarn pattern that is woven, knitted, and/or sewn with an active material filament or inlay. This active material filament/inlay responds to an external stimulus (e.g., an electrical, thermal, or magnetic activation signal) with a physical change that concomitantly modulates the texture and, thus, the frictional properties of an outer contact surface of the textile structure. Other disclosed active textile structures are manufactured using a tension-knit pattern that responds to a boundary control change by switching the upper/outermost thread from a low-friction filament to a high-friction filament (or vice versa) to thereby initiate a texture and friction change at a contact surface of the textile structure. Texture changes may be initiated using one or more external actuators, including pneumatic, hydraulic, and/or thermal actuators. In an example, a vibrational actuator is selectively actuable to pull, push or otherwise move one or more textile filaments such that one or more textile filaments shift upwardly or outwardly to define an outer contact surface of the textile structure.

Aspects of this disclosure are directed to components and assemblies formed, in whole or in part, from an active textile structure having selectively variable surface friction characteristics. For instance, an active textile system is presented for governing frictional force levels at an interface with a user or object. The active textile system includes a textile structure formed with a first textile filament that is interlaced with a second textile filament. The first textile filament has a first texture that exhibits a first coefficient of friction (COF), whereas the second textile filament has a second texture that exhibits a second coefficient of friction, which is different than the first coefficient of friction. The textile structure has an outer contact surface at the interface with the user/object. The active textile system also includes an actuating element that is functionally connected to the textile structure to selectively transition the textile structure between first and second states. When the textile structure is in the first state, the first textile filament defines most or all of the outer contact surface of the textile structure, e.g., such that the contact surface similarly exhibits the first coefficient of friction. Conversely, when the textile structure is in the second state, the second textile filament defines most or all of the textile structure's outer contact surface, e.g., such that the contact surface similarly exhibits the second coefficient of friction.

For any of the herein described aspects and features, the actuating element may include an active material transducer that is physically attached to the textile structure. In an example, the active material transducer may include a piezoelectric actuator that is embedded within the textile structure. The piezoelectric actuator is actuable, e.g., via an electrical activation signal, to move the second textile filament outboard past the first textile filament and thereby transition the textile structure from the first state to the second state. The piezoelectric actuator may include a single piezoelectric insert mounted on or within the textile structure, or an array of piezoelectric inserts nested within gaps between the first and second textile filaments.

For any of the herein described aspects and features, the active material transducer may include a shape-memory alloy (SMA) filament and/or shape-memory polymer (SMP) filament that is embedded within the textile structure. The SMA and/or SMP filament is actuable, e.g., via an (electric or thermal or magnetic) activation signal, to move the second textile filament outboard past the first textile filament to thereby transition the textile structure from the first state to the second state. Optionally, the SMA and/or SMP filament may be a single SMA and/or SMP weft that is woven with the first and second textile filaments. As another option, the SMA and/or SMP filament may include multiple SMA and/or SMP threads that are woven, knitted, and/or sewn with the first and second textile filaments. As used herein, the term "transducer" encompasses unidirectional and bidirectional actuators and transducers.

For any of the herein described aspects and features, the active material transducer may include an electroactive polymer (EAP) filament and/or an electrorheological polymer (ERP) insert that is embedded within the textile structure. The EAP filament and/or ERP insert is actuable, e.g., in response to an (electric field) activation signal, to move the second textile filament outboard past the first textile filament to thereby transition the textile structure from the first state to the second state. For any of the herein described aspects and features, the first and second textile filaments may be interlaced in a tension-knit pattern that positions the first (or the second) textile filament outboard from the second (or the first) textile filament, i.e., such that the first (or the second) textile filament defaults as the textile structure's outer contact surface. With this configuration, a change in tension, boundary control, or other physical attribute, will shift outward and, thus, expose the second (or the first) textile filament.

For any of the herein described aspects and features, the actuating element may include a boundary control actuator that is physically attached to the textile structure and operable to reposition the textile filaments such that the second textile filament is shifted outboard past the first textile filament to thereby define most/all of the outer contact surface of the textile structure. The boundary control actuator may include a support frame, which is attached to an outer perimeter of the textile structure, and an electronic actuator, which is selectively actuable to reposition the support frame and thereby reposition the first and second textile filaments. Optionally, the actuating element may include a pneumatic and/or hydraulic actuator that is attached to the textile structure, and operable to reposition the textile filaments such that the second textile filament is shifted outboard past the first textile filament to thereby define most/all of the textile structure's outer contact surface. The pneumatic and/or hydraulic actuator may include a series of fluid tubes embedded within the textile structure, and a fluid-compressing device that controls fluid pressure within the fluid tubes. As another option, the actuating element includes a vibrational actuator that is attached to the textile structure, and is operable to reposition the textile filaments such that the second textile filament shifts outboard past the first textile filament to thereby define the outer contact surface. The vibrational actuator may include a linear resonant actuator and/or an eccentric rotating mass (ERM) motor.

Additional aspects of this disclosure are directed to methods for making and methods for using active textile structures having selectively variable surface friction and surface texture characteristics. For instance, a method is presented for assembling an active textile system, e.g., for governing frictional force levels at a user/object interface. The representative method includes, in any order and in any combination with any of the above and below disclosed features and options: assembling a textile structure, including interlacing a first textile filament with a second textile filament, where the first textile filament has a first texture with a first coefficient of friction, and the second textile filament has a second texture with a second coefficient of friction that is higher (or lower) than the first coefficient of friction, the textile structure having an outer contact surface at an interface with a user or an object; and, operatively connecting an actuating element to the textile structure. The actuating element is operable to selectively transition the textile structure between at least two states: a first state, which includes the first textile filament defining most or all of the outer contact surface of the textile structure, and a second state, which includes the second textile filament defining most or all the textile structure's outer contact surface. The textile structure may be assembled using any suitable fabrication process, including knitting, weaving, knotting, felting, crocheting, etc.

Other aspects of the present disclosure are directed to vehicle components and motor vehicles equipped with any such vehicle components with at least one feature that is fabricated, in whole or in part, from electronically controlled textile structures with selectively modifiable surface texture and friction characteristics. As used herein, the term "motor vehicle" may include any relevant vehicle platform, such as passenger vehicles (internal combustion engine, hybrid electric, full electric, fuel cell, fuel cell hybrid, fully or partially autonomous, etc.), commercial vehicles, industrial vehicles, tracked vehicles, off-road and all-terrain vehicles (ATV), farm equipment, watercraft, aircraft, etc. It is envisioned that any of the disclosed active textile structures, systems, and methods may be utilized for both automotive and non-automotive applications.

The above summary is not intended to represent every embodiment or every aspect of the present disclosure. Rather, the foregoing summary merely provides an exemplification of some of the novel concepts and features set forth herein. The above features and advantages, and other features and advantages, will be readily apparent from the following detailed description of illustrated embodiments and representative modes for carrying out the disclosure when taken in connection with the accompanying drawings and appended claims. Moreover, this disclosure expressly includes any and all combinations and subcombinations of the elements and features presented above and below.

Figure 1:
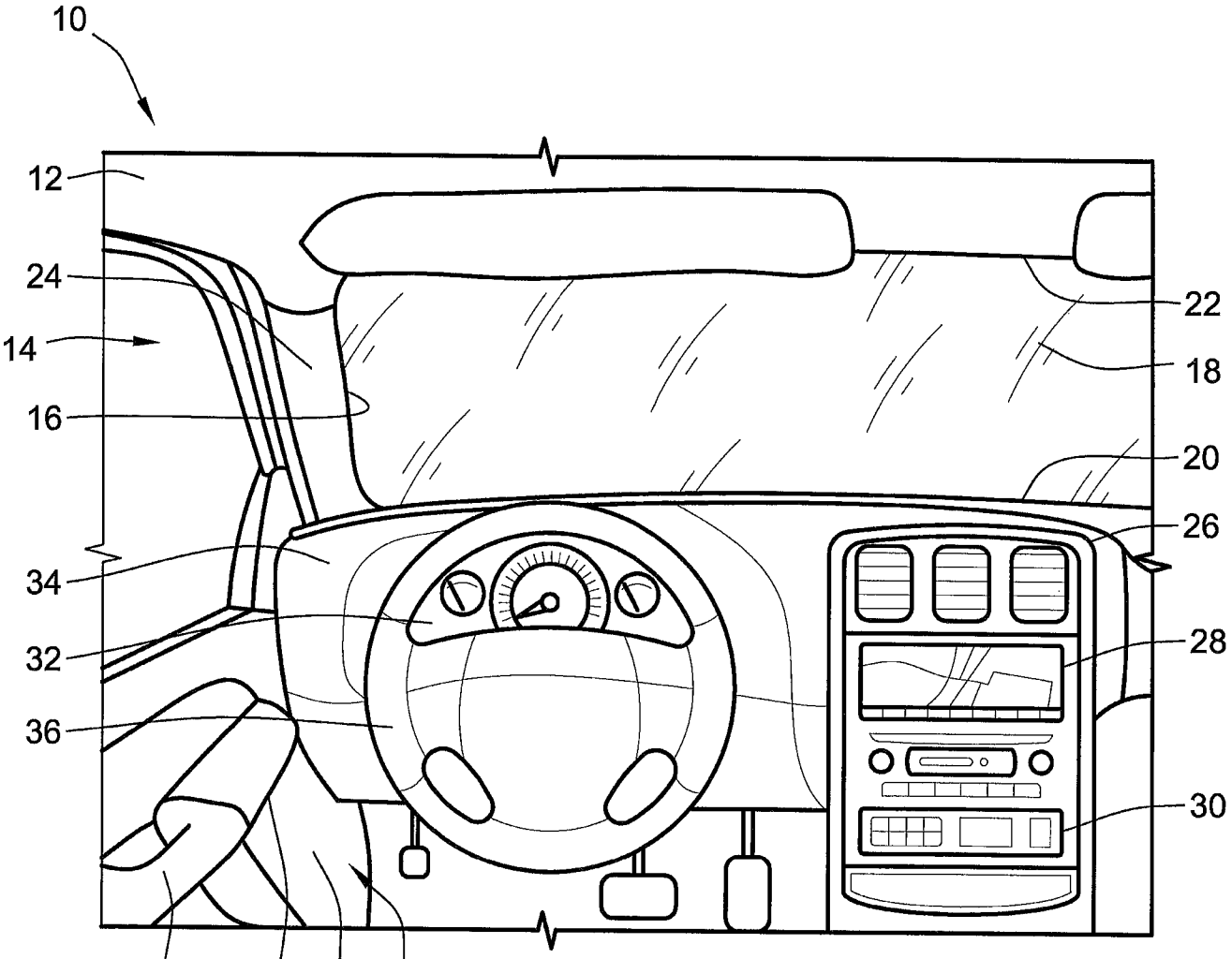
FIG. 1 is a perspective-view illustration of a portion of a representative vehicle passenger compartment presenting various vehicle components that may be fabricated, in whole or in part, from an active textile structure with selectively variable surface friction characteristics in accordance with aspects of the present disclosure.

The present disclosure is amenable to various modifications and alternative forms, and some representative embodiments have been shown by way of example in the drawings and will be described in detail herein. It should be understood, however, that the novel aspects of this disclosure are not limited to the particular forms illustrated in the above-enumerated drawings. Rather, the disclosure is to cover all modifications, equivalents, combinations, subcombinations, permutations, groupings, and alternatives falling within the scope of this disclosure as defined by the appended claims.

DETAILED DESCRIPTION

This disclosure is susceptible of embodiment in many different forms. There are shown in the drawings and will herein be described in detail representative embodiments of the disclosure with the understanding that these illustrated examples are provided as an exemplification of the disclosed principles, not limitations of the broad aspects of the disclosure. To that extent, elements and limitations that are described, for example, in the Abstract, Introduction, Summary, and Detailed Description sections, but not explicitly set forth in the claims, should not be incorporated into the claims, singly or collectively, by implication, inference or otherwise.

For purposes of the present detailed description, unless specifically disclaimed: the singular includes the plural and vice versa; the words "and" and "or" shall be both conjunctive and disjunctive; the word "all" means "any and all"; the word "any" means "any and all"; and the words "including" and "comprising" and "having" mean "including without limitation." Moreover, words of approximation, such as "about," "almost," "substantially," "approximately," and the like, may be used herein in the sense of "at, near, or nearly at," or "within 0-5% of," or "within acceptable manufacturing tolerances," or any logical combination thereof, for example. Lastly, directional adjectives and adverbs, such as fore, aft, inboard, outboard, starboard, port, vertical, horizontal, upward, downward, front, back, left, right, etc., may be with respect to a motor vehicle, namely a forward driving direction of a motor vehicle when the vehicle is operatively oriented on a normal driving surface, for example.

Referring now to the drawings, wherein like reference numbers refer to like features throughout the several views, there is shown in FIG. 1 a perspective-view illustration of a representative automobile, which is designated generally at 10 and portrayed herein for purposes of discussion as a passenger-type sport utility vehicle (SUV). Mounted on the vehicle body 12 of the automobile 10, e.g., to a roof rail, chassis cross-member, front cowl, rear deck, etc., within a passenger compartment 14, is an assortment of representative vehicle components that may each be fabricated, in whole or in part, from an active textile structure with selectively variable surface friction characteristics. The illustrated automobile 10—also referred to herein as "motor vehicle" or "vehicle" for short—is merely an exemplary application with which novel aspects and features of this disclosure may be practiced. In the same vein, implementation of the present concepts into the vehicle components presented in FIG. 1 should also be appreciated as an exemplary application of the novel concepts disclosed herein. As such, it will be understood that aspects and features of the present disclosure may be applied to other vehicle components, utilized for any logically relevant type of motor vehicle, and implemented for both automotive and non-automotive applications alike. Lastly, the drawings presented herein are not necessarily to scale and are provided purely for instructional purposes. Thus, the specific and relative dimensions shown in the drawings are not to be construed as limiting.

In accord with the illustrated example, a front windshield 18 is sealingly fastened, e.g., via a bonding agent and a window gasket or polymeric weather stripping (not shown), within a front window frame 16. A lower edge of the front window frame 16 is delineated by a dash panel cowl fascia 20, whereas an upper edge is delineated by a roof reinforcement panel 22, and the two lateral edges are demarcated by a pair of A-pillar trim covers 24 (only one of which is visible; a second mirrored counterpart is located on the opposite side of the window frame 16). Also present within the vehicle passenger compartment 14 is a center stack console 26 that is equipped with, among other things, a touchscreen video display 28 and a button panel 30. Touchscreen video display 28 and button panel 30 are individually operable to receive user inputs, whereas the video display 28 outputs image, text, and video-based content. A digital instrument panel (IP) 32, which is housed within a front dashboard 34 forward of a steering wheel 36, displays gauges, instrumentation, and controls for monitoring and regulating selected operations of the vehicle 10. A driver-side door assembly 38 is shown pivotably mounted, e.g., via a multi-stage check-spring door hinge, to the vehicle body 12 to provide access to and securely close a portion of the passenger compartment 14. Mounted along an inboard-facing (inside) surface of a door inner fascia panel 40 is a handle chassis 42 that provides subjacent support for operation of the door handle 44.

Figure 2A:
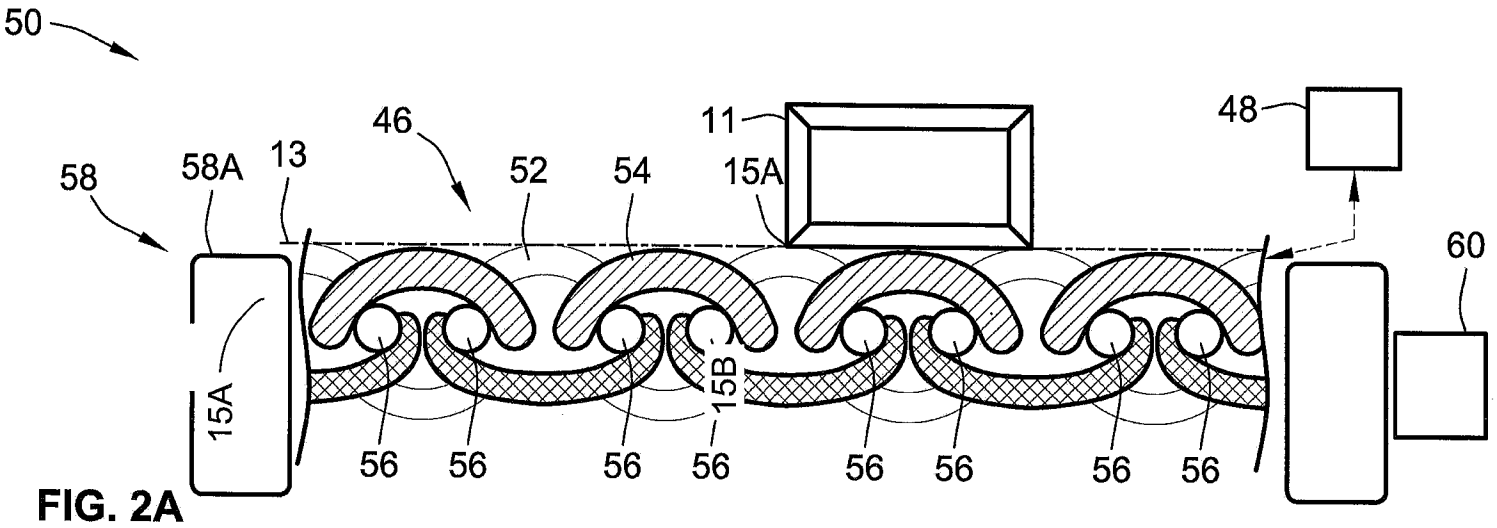
FIG. 2A is a cross-sectional, side-view illustration of a representative active textile structure shown in a first state with an outer contact surface exhibiting a first coefficient of friction in accordance with aspects of the present disclosure.
Figure 2B:
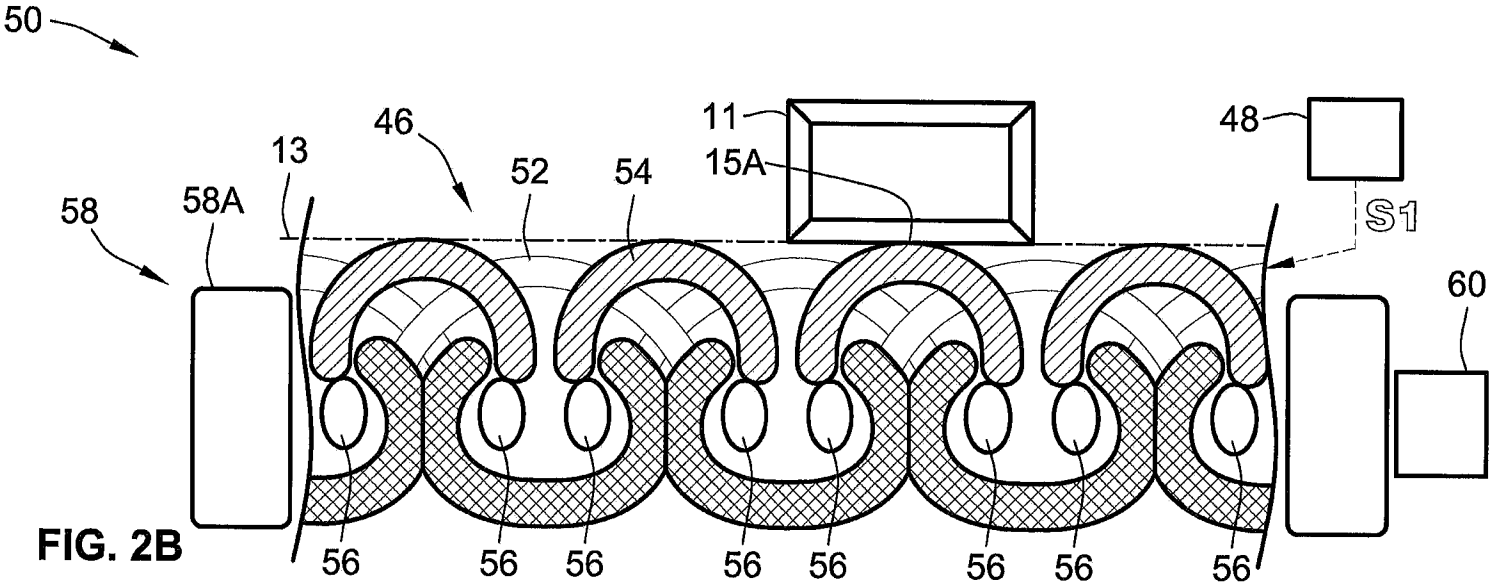
FIG. 2B is a cross-sectional, side-view illustration of the representative active textile structure of FIG. 2 shown in a second state with an outer contact surface exhibiting a distinct second coefficient of friction.

Many of the above-described vehicle components, including the cowl fascia 20, trim portions of the dashboard 34, and the door handle 44 and handle chassis 42, as well as many other common vehicle components, including the trim material of a vehicle seat assembly and the trim portions of an armrest or center console, may include features that are manufactured from an active textile structure with selectively variable surface texture and friction characteristics. An example of an electronically controlled ("active"), variable-friction textile structure is illustrated in FIGS. 2A and 2B, designated generally therein at 46. The term "textile", as used herein, may refer to a fabric or cloth that is formed from natural or synthetic fibers by knitting, weaving, crocheting, braiding, bonding, lacing, or any other suitable process for textile production. A textile material may be composed of one or more organic fibers, such as animal-based and plant-based fibers, one or more synthetic fibers, such as polymer-based and glass-based fibers, and/or one or more metal-based fibers, such as silver, gold, or aluminum filaments and aluminized yarns. Textile materials made using a combination of these methods and/or materials could have portions that incorporate multiple structures, for example: a knitted portion formed using braided fibers; fibers woven through a knitted or crocheted structure, e.g., to provide dimensional strength and/or stabilization; a crocheted edge formed on a knitted or woven structure; woven layers knitted together to form a multi-layer textile material such as a 3D textile material, etc. Some textile materials include more than one type of fiber, including one or more organic fibers, synthetic fibers, and metal-based fibers, as well as a blended fiber, such as an animal/synthetic blended fiber, an animal/plant blended fiber, a plant/synthetic blended fiber, a glass/polymer blended fiber (fiberglass), a metal/polymer blended fiber, etc., and any combination thereof.

Natural fibers are any fibers that are produced by or from plants, animals, and geological processes. Animal fiber may include fibers produced from the hair and/or fur of an animal providing hair/fur suitable for fiber production, as well as silk fibers produced from insect cocoons, and the like. Plant-based fiber, by comparison, may include fiber produced from any plant providing a plant material which is suitable for fiber production, including cotton, flax, wood (acetate, rayon), bamboo, jute, hemp, etc., as some non-limiting examples. In contrast, synthetic fibers are generally made from synthesized polymers, and may include fibers made of one or more of acrylic, KEVLAR®, nylon, nomex, polyester, spandex, and the like. Synthetic fiber may be formed, as some non-limiting examples, by spinning, extrusion, drawing, and the like. A textile material may be formed of a yarn including a plurality of fibers which have been spun or twisted together or otherwise interlocked or joined to form a yarn. The textile material may include monofilament fiber, polyfilament fiber, staple fiber, or a combination of these and other commercially available fibers.

According to the representative architecture illustrated in FIGS. 2A and 2B, the textile structure 46 may generally consist of a substantially flat, unitary knitted sheet. Optionally, the textile structure 46 may be formed as a multi-dimensional and/or multi-layer material, taking on any desired shape and size for an intended application. Textile structure 46 of FIGS. 2A and 2B may be formed using a single technique or a combination of techniques. For instance, the textile structure 46 may be a knitted 3D material into which coarse and/or whale and/or inlaid threads are woven to provide for directional properties, such as directional stretchability, pretension, predetermined distortion of spaces in the textile structure under load, damping characteristics, etc. For multi-layer constructions, the textile structure 46 may include interconnected layers formed by a single technique, such as a double-layer weave composition, or include at least one of multiple layers formed by a different technique than at least one of the other layers. It is envisioned that the textile structure 46 may be formed by weaving, knitting, crocheting, braiding, and the like, e.g., such that fibers are spaced from one another and may move relative to one another, for example, under load, such that fiber spacing and orientation may change dimension, shape, and orientation in response to a change in the direction and magnitude of a load being imposed on the textile structure 46.

Continuing with the above example, the textile structure 46 may be characterized as one or more of elastic, stretchable, porous, and bendable and, optionally, capable of providing a desired response, including one or more of a stiffness response, an energy dissipation response, a shape-shifting response, a thermal response, a texture changing response, a surface friction changing response, etc. Textile structure 46 may be fabricated with a hydrophobic, hydrophilic, wicking, or porous configuration, e.g., provided by predetermined spacing between fibers forming the textile, to provide for fluid flow (heat, air, and vapor including water vapor) into and/or through the textile material. The rate and capacity of the fluid flow and diffusivity of the textile material may change as an applied load is varied. Response characteristics of the textile structure 46 may be varied by modifying a stitch type, a stitch pattern, a yarn type, a yarn denier, a needle size, a fiber type, a fiber size, a stitch density, a warp pattern, a weft pattern, a weave type, a braiding pattern, etc., of the textile material. These features of the textile material may help to determine characteristics of the textile structure 46, including density, thickness, porosity, conductivity, elasticity, surface friction, etc., of the textile material, and the shape, size and orientation and dynamic response of spaces defined between the fibers in the textile material.

The variable-friction textile structure 46 of FIGS. 2A and 2B communicates—wired or wirelessly—with a programmable electronic control unit (ECU) 48 as part of an active textile system 50 that governs frictional force levels at an interface 13 with a user or object (represented herein by object 11). Vehicle ECU 48 may systematically monitor various in-vehicle sensors, system components, vehicle inputs (both manual and automated), etc., and may communicate with one or more remote systems, servers, and vehicles; from the received inputs and data, the ECU 48 is programmed to selectively modify the texture and, thus, the surface friction at an outer contact surface of the textile structure 46, which is represented in the drawings by upper contact surface 15A of FIG. 2A and upper contact surface 15B of FIG. 2B. This ECU 48 may communicate directly with various systems, subsystems, and components, or the ECU 48 may alternatively or additionally communicate over a distributed computing network, such as a local area network (LAN) or campus area network (CAN) system, a satellite system, the Internet, etc. As an example, a driver of automobile 10 of FIG. 1 may wish to securely rest an object 11, such as a smartphone or set of keys, on the front dashboard 34 or an adjacent passenger seat, either of which may have an interface 13 that is defined by the contact surface 15A, 15B of the textile structure 46. Vehicle ECU 48 may concomitantly receive inputs and data, e.g., in the nature of a driver command entered via touchscreen video display 28 or a pressure sensor signal operatively connected at the interface 13 to detect the presence of the object 11. In response to received input/data, e.g., the ECU 48 may be programmed to modify the texture of the textile structure 46 at the contact surface 15A, 15B to thereby increase surface frictional forces experienced by the object 11 (smartphone/keys) at the interface 13.

As indicated above, vehicle ECU 48 is constructed and programmed to govern, among other things, operation of the textile structure 46. Control module, module, controller, control unit, electronic control unit, processor, and any permutations thereof may be defined to mean any one or various combinations of one or more of logic circuits, Application Specific Integrated Circuit(s) (ASIC), electronic circuit(s), central processing unit(s) (e.g., microprocessor(s)), and associated memory and storage (e.g., read only, programmable read only, random access, hard drive, tangible, etc.)), whether resident, remote or a combination of both, executing one or more software or firmware programs or routines, combinational logic circuit(s), input/output circuit(s) and devices, appropriate signal conditioning and buffer circuitry, and other components to provide the described functionality. Software, firmware, programs, instructions, routines, code, algorithms and similar terms may be defined to mean any controller executable instruction sets including calibrations and look-up tables. The ECU 48 may be designed with a set of control routines executed to provide the desired functions. Control routines are executed, such as by a central processing unit, and are operable to monitor inputs from sensing devices and other networked control modules, and execute control and diagnostic routines to control operation of devices and actuators. Routines may be executed at in real-time, continuously, systematically, sporadically and/or at regular intervals, for example, each 100 microseconds, 3.125, 6.25, 12.5, 25 and 100 milliseconds, etc., during ongoing vehicle use or operation. Alternatively, routines may be executed as a direct response to occurrence of an event during operation of vehicle 10.

Textile structure 46 of FIGS. 2A and 2B is fabricated with at least two structurally distinct filaments that are movable with respect to one another such that the coefficient of friction (COF) of the textile structure 46 at the interface 13 with the user/object 11 is selectively modifiable. In accord with the illustrate example, a first textile filament 52 is interlaced, e.g., via knitting, weaving or crocheting, with a second textile filament 54. As used herein, the term "filament" may encompass fibers, yarns, threads, thread-like structures, strands, wires, etc. First textile filament 52, which may be in the nature of a polyester, lyocell, bamboo fiber, or a blend thereof, for example, has a first (smooth or semi-smooth) texture with a first coefficient of friction (e.g., static coefficient of friction (μs) of about 0.7 to 0.8 or less). Contrastingly, the second textile filament 54, which may be in the nature of a cotton, bamboo charcoal, hemp, or a blend thereof, for example, has a second (semi-rough or rough) texture with a second coefficient of friction (e.g., μs of about 0.85 to 0.95 or greater). In general, the coefficient of friction of the first textile filament 52 is distinct from the coefficient of friction of the second textile filament 52, i.e., by more than a mathematically significant amount (e.g., greater than about 3 to 5%). Additives, coatings, post-processing, impregnating elements, and modifications to textile cover factor may be applied to increase or decrease the COF of a particular one or both of the filaments 52, 54 as desired. While described above as the "low friction" component, the first textile filament 52 may have a COF that is higher than the COF of the second textile filament 52, e.g., depending upon the intended application of the active textile system 50. It is also envisioned that the first and second filaments 52, 54 may be fabricated from the same material or composition of materials so long as the resultant structures have distinct texture and friction characteristics.

With continuing reference to FIGS. 2A and 2B, the first and second textile filaments 52, 54 may be interlaced in a tension-knit pattern that defaults to position the first textile filament 52 outboard (upward in FIG. 2A) from the second textile filament 54 such that the first textile filament 52 defines the textile structure's 46 upper contact surface 15A, e.g., when the active textile system 50 is in a first (deactivated) stable state. In an example, textile structure 46 may be formed from two distinct yarns that are processed, e.g., in a knitting machine, to form intermeshed loops of courses and wales that define a knit sheet. For at least some configurations, one or more sets of adjacent areas of the knit sheet may share at least one common course or at least one common wale. Knit reinforcement structural sheets may be formed via weft knitting operations, warp knitting operations, flat knitting operations, circular knitting operations, or other suitable methods. In this regard, textile structure 46 may be formed on a computer numerical control (CNC) knitting machine, such as a CNC flatbed weft knitting machine. Such CNC knitting machines allow for controlled variability across different types of fibers used during a single knitting operation, including regulation of fiber tension and other structural characteristics, e.g., to produce differentiated conditions to achieve different levels of prestress in the overall textile sheet. Gross topology of the formed textile may be highly varied, for example, using a CNC machine with multiple knitting rows that allow for complex topologies of intersecting tubes and volumes to be formed of completely continuous knit structures with minimal anomalous conditions.

Active textile system 50 employs one or more electronically controlled actuating elements, such as the various actuating elements described below and interchangeably designated as 56, 58, and/or 60, to selectively transition the textile structure 46 between two or more stable states, each of which exhibits a distinct surface texture and, thus, a distinct static/sliding COF at the interface 13 with the user/object 11. When the textile structure 46 is in a first state—an example of which is portrayed in FIG. 2A and may be configured as a deactivated and/or default state—the first (low friction) textile filament 52 is positioned to define the outer contact surface of the textile structure 46. As shown in FIG. 2A, for example, multiple segments of the first textile filament 52 protrude upwardly past the upper extent of the second textile filament 54; in so doing, the first textile filament 52 effectively defines most or all of the uppermost/outermost contact surface 15A against which is seated the user/object 11. Conversely, when the textile structure 46 is transitioned from the first state to a second state—an example of which is portrayed in FIG. 2B and may be configured as an activated and/or triggered state—the second (high friction) textile filament 54 is positioned to define the textile structure's contact surface at the interface with the user/object 11. In particular, the vehicle ECU 48 transmits a command or activation signal S1 to one or more or all of the actuating element(s) 56, 58, 60 to shift one or both textile filaments 52, 54 such that segments of the second textile filament 54 protrude upwardly past the upper extent of the first textile filament 52. By shifting the filaments in this manner, the second textile filament 54 effectively defines most or all of the uppermost/outermost contact surface 15B against which is seated the user/object 11. While illustrated as having only two stable states—a first (deactivated) state of FIG. 2A and a second (activated) state of FIG. 2B—the textile structure 46 may be configured to transition to additional states. In the same vein, the first state of FIG. 2A may be configured as the activated state, while the second state of FIG. 2B may be configured as the deactivated state.

For at least some system architectures, the actuating element(s) 56, 58, 60 may generally comprise one or more active material transducers 56 that are physically attached to the textile structure 46. As used herein, the term "active material" may generally refer to a material that exhibits a temporary change in a physical property, such as shift of dimension, shape, orientation, shear force, elastic modulus, flexural modulus, yield strength, stiffness, and the like, as a direct response to an activation signal S1. Suitable active materials include, without limitation, shape memory alloys (SMA), shape memory polymers (SMP), electroactive polymers (EAP), piezoelectric materials, electrorheological polymers (ERP), electrostrictive materials, magnetostrictive materials, and the like. Depending on the particular active material employed by the system 50, an activation signal S1 may take the form of, without limitation, an electric current, an electric field (voltage), a temperature change, a magnetic field, a mechanical loading or stressing (such as superelasticity in SMA), a chemical change (such as a pH change), and the like. An active material may change at least one physical property in response to an activation signal S1 and, upon discontinuation of the activation signal S1, revert back to the original state of the at least one property. For classes of active materials that do not automatically revert upon discontinuation of the activation signal S1, alternative means may be employed to revert the active material to its original state. The vehicle ECU 48 functions, at least in part, as an activation device that is operable to selectively provide an activation signal S1 to the active-material-based transducer(s) 56. By altering a physical property of the active material transducer(s) 56, e.g., via activation signal S1, the system 50 changes a frictional force level experienced by a user/object 11 that contacts the textile structure 46. The ECU 48 may be configured to control the nature of the active material's property change, e.g., the magnitude and duration, the concomitant change in frictional force levels at the interface 13 between contact surfaces of the bodies.

For system configurations in which an actuating element 56, 58, 60 is embodied as an active material transducer 56, one or more of the actuating elements 56, 58, 60 may include a piezoelectric actuator that is inserted into, enclosed by, or otherwise embedded within the textile structure 46 (e.g., as exemplified in FIGS. 2A and 2B). These piezoelectric actuators may take on various forms, including an array—multiple rows and multiple columns—of piezoelectric inserts, each of which is nested within a respective gap between the two textile filaments 52, 54. In addition, or alternatively, one or more of the actuating elements 56 may include an SMA filament and/or an SMP filament that is inserted into, enclosed by, or otherwise embedded within the textile structure 46. For at least some embodiments, the SMA and/or SMP filament consists of a single SMA/SMP weft that is woven with the first and second textile filaments 52, 54. Optionally, the SMA/SMP filament may comprise multiple SMA and/or SMP threads that are knitted with the textile filaments 52, 54 of the textile structure 46. As yet another option, one or more of the actuating elements 56, 58, 60 of FIGS. 2A and 2B may include an EAP filament and/or an ERP insert that is inserted into, enclosed by, or otherwise embedded within the textile structure 46. Irrespective of which type of active material element is employed, the actuating elements 56 are activated as desired by an activation signal S1 (FIG. 2B) generated and output by the ECU 48. In the illustrated example, activation of the actuating elements 56 causes the active-material based actuating elements 56 to expand or bend. In so doing, the actuating elements 56 push, guide or otherwise move the second textile filament 54 outboard (upward in FIG. 2B) past the first textile filament 52 such that the user/object 11 abuts that second textile filament 54 and not the first textile filament 52.

For at least some system architectures, the actuating element(s) 56, 58, 60 may generally comprise a boundary control actuator (generally designated at 58 in the drawings) that is physically attached along the outer perimeter (or "boundary") of the textile structure 46. This boundary control actuator 58 is actuable, e.g., in response to an electronic signal S1 from the ECU 48, to twist, shift, or otherwise reposition one or both of the first and second textile filaments 52, 54. By repositioning the textile filaments 52, 54 in this manner, the second textile filament 54 is moved outboard past the first textile filament 52 such that the second textile filament 54 defines most or all of the outer contact surface of the textile structure 46 (e.g., upper contact surface 15B of FIG. 2B). According to the representative architecture illustrated in FIGS. 2A and 2B, the boundary control actuator 58 includes a support frame 58A, which is physically attached to the outer perimeter of the textile structure 46, and an electronically controlled/activated actuator 60, which to operatively attached to the support frame 58A operable to reposition the support frame 58A (or select portions thereof) to reposition the first and/or second textile filament 52, 54. In this particular instance, the electronically controlled/activated actuator 60 may be a two-way electric servo motor or any other type of electronically activated device suitable for the intended function.

For at least some system architectures, the actuating element(s) 56, 58, 60 may generally comprise or may generally consist of an electronically controlled/activated pneumatic and/or hydraulic actuator 60 that is physically attached—either directly or indirectly—to the textile structure 46. As indicated above, the electronically controlled/activated actuator 60 may transition the active textile structure 56 from the first state (FIG. 2A) to the second state (FIG. 2B) through cooperative operation with a frame 58A or other interface between the actuator 60 and textile structure 46. Alternatively, one or more pneumatic and/or hydraulic actuators 60 may have a direct mechanical coupling with the textile structure 46 to reposition the textile filaments 52, 54. In a non-limiting example, the pneumatic and/or hydraulic actuator 60 may include a series of fluid tubes (which may be represented by the elements indicated at 56 in FIGS. 2A and 2B) embedded within the textile structure 46, and a fluid-compressing device (which may be represented by actuator 60) that is fluidly connected to the fluid tubes. Alternatively, the electronically controlled/activated actuator 60 may be in the nature of a vibrational actuator that is physically attached to the textile structure 46, and selectively actuable in response to an electronic signal to reposition the first and/or second textile filaments 52, 54. The vibrational actuator may take on various available forms, including a linear resonant actuator and/or an eccentric rotating mass (ERM) motor.

Aspects of the present disclosure are directed to methods for manufacturing and methods for implementing and of the herein disclosed active textile structures and/or active textile systems. In an example, there is presented a method of assembling the active textile system 50 of FIGS. 2A and 2B. Some or all of the operations described in further detail below may be representative of an algorithm that corresponds to processor-executable instructions that may be stored, for example, in main or auxiliary or remote memory, and executed, for example, by a central processing unit (CPU), control logic circuit, or other module or device, to perform any or all of the above and below described functions associated with the disclosed concepts. It should be recognized that the order of execution of the described operation blocks may be changed, additional blocks may be added, and some of the blocks described may be modified, combined, or eliminated. Routines may be executed in real-time, continuously, systematically, sporadically and/or at regular intervals, for example, each 100 microseconds, 3.125, 6.25, 12.5, 25 and 100 milliseconds, etc., during ongoing vehicle use or operation. Alternatively, routines may be executed in response to occurrence of an event, e.g., during operation of a vehicle.

The assembly method includes, for example, assembling an active textile structure 46, e.g., via interlacing a first textile filament 52 with a second textile filament 54. As indicated above, the first textile filament 52 has a distinct (first) texture with a predetermined (first) COF. Conversely, the second textile filament 54 has a distinct (second) texture with a predetermined (second) COF that is markedly greater than or less than the COF of the first textile filament 52. The textile structure 46 is operatively connected to any of the above-described electronically controlled actuating elements 56, 58, and/or 60. As indicated above, this actuating element 56, 58, 60 may be adapted to selectively switch the textile structure 46 from a first state (FIG. 2A) to a second state (FIG. 2B), and vice versa. When the textile structure 46 is in the first state, the first textile filament 52 is positioned relative to the second textile filament 54 such that the first filament 52 defines most/all of the textile structure's outer contact surface 54. On the other hand, when the textile structure 46 is switched to the second state, the second textile filament 54 is moved outboard from the first textile filament 52 (upwardly in FIG. 2B) to define most/all of the outer contact surface 15A at the interface 13.

It should be appreciated that the textile structure, including the interlaced first and second textile filaments, may be incorporated into one or more discrete, localized areas within a larger textile field. As yet another option, the textile structure may be fabricated as multiple discrete areas or "patches" with an active friction construction, each of which may be controlled independently, collectively, sequentially or in any desired manner. In yet another option, a single "active" textile structure may be configured to exhibit multiple levels of frictional change (e.g., a first course of a knit textile structure may triggered in a first state, two courses of the knit textile structure may triggered in a second state, etc.) to create multiple different levels of surface friction.

Aspects of the present disclosure have been described in detail with reference to the illustrated embodiments; those skilled in the art will recognize, however, that many modifications may be made thereto without departing from the scope of the present disclosure. The present disclosure is not limited to the precise construction and compositions disclosed herein; any and all modifications, changes, and obvious variations apparent from the foregoing descriptions are within the scope of the disclosure as defined by the appended claims. Moreover, the present concepts expressly include any and all combinations and subcombinations of the preceding elements and features.

What is claimed:

1. An active textile system for governing frictional force levels at an interface with a user or object, the active textile system comprising:

a textile structure including a first textile filament interlaced with a second textile filament, the first textile filament having a first texture with a first coefficient of friction, and the second textile filament having a second texture with a second coefficient of friction different than the first coefficient of friction, the textile structure having an outer contact surface at the interface with the user or object, wherein the first and second textile filaments are interlaced in a tension-knit pattern that positions the first textile filament outboard from the second textile filament to thereby define the outer contact surface; and an actuating element including a boundary control actuator attached to the textile structure and configured to selectively transition the textile structure between first and second states, the first state including the first textile filament defining the outer contact surface of the textile structure, and the second state including the second textile filament defining the outer contact surface, the boundary control actuator repositioning the first and second textile filaments such that the second textile filament is outboard from the first textile filament to thereby define the outer contact surface of the textile structure, the boundary control actuator including a support frame and an electronically controlled actuator, the support frame being attached to an outer perimeter of the textile structure, and the electronically controlled actuator being selectively actuable to reposition the support frame and thereby reposition the first and second textile filaments.

2. An active textile system for governing frictional force levels at an interface with a user or object, the active textile system comprising:

a textile structure including a first textile filament interlaced with a second textile filament, the first textile filament having a first texture with a first coefficient of friction, and the second textile filament having a second texture with a second coefficient of friction different than the first coefficient of friction, the textile structure having an outer contact surface at the interface with the user or object, wherein the first and second textile filaments are interlaced in a tension-knit pattern that positions the first textile filament outboard from the second textile filament to thereby define the outer contact surface, and an actuating element including a pneumatic and/or hydraulic actuator attached to the textile structure and configured to selectively transition the textile structure between first and second states, the first state including the first textile filament defining the outer contact surface of the textile structure, and the second state including the second textile filament defining the outer contact surface, the pneumatic and/or hydraulic actuator repositioning the first and second textile filaments such that the second textile filament is outboard from the first textile filament to thereby define the outer contact surface of the textile structure.

3. The active textile system of claim 2, wherein the pneumatic and/or hydraulic actuator includes a plurality of fluid tubes embedded within the textile structure, and a fluid-compressing device fluidly connected to the plurality of fluid tubes and operable to selectively expand and contract the plurality of fluid tubes.

4. An active textile system for governing frictional force levels at an interface with a user or object, the active textile system comprising:

a textile structure including a first textile filament interlaced with a second textile filament, the first textile filament having a first texture with a first coefficient of friction, and the second textile filament having a second texture with a second coefficient of friction different than the first coefficient of friction, the textile structure having an outer contact surface at the interface with the user or object, wherein the first and second textile filaments are interlaced in a tension-knit pattern that positions the first textile filament outboard from the second textile filament to thereby define the outer contact surface; and an actuating element including a vibrational actuator attached to the textile structure and configured to selectively transition the textile structure between first and second states, the first state including the first textile filament defining the outer contact surface of the textile structure, and the second state including the second textile filament defining the outer contact surface, the vibrational actuator repositioning the first and second textile filaments such that the second textile filament is outboard from the first textile filament to thereby define the outer contact surface of the textile structure, wherein the vibrational actuator includes a linear resonant actuator and/or an eccentric rotating mass (ERM) motor.

5. The active textile system of claim 4, wherein the first textile filament includes a first plurality of fibers, yarns, threads, thread-like structures, strands, and/or wires, and wherein the second textile filament includes a second plurality of fibers, yarns, threads, thread-like structures, strands, and/or wires.

6. The active textile system of claim 1, wherein the first textile filament includes a first plurality of fibers, yarns, threads, thread-like structures, strands, and/or wires, and wherein the second textile filament includes a second plurality of fibers, yarns, threads, thread-like structures, strands, and/or wires.

7. The active textile system of claim 2, wherein the first textile filament includes a first plurality of fibers, yarns, threads, thread-like structures, strands, and/or wires, and wherein the second textile filament includes a second plurality of fibers, yarns, threads, thread-like structures, strands, and/or wires.

8. The active textile system of claim 1, wherein the electronically controlled actuator includes a pneumatic and/or hydraulic actuator physically attached to the textile structure.

9. The active textile system of claim 4, wherein the first textile filament is interlaced with the second textile filament via knitting, weaving, crocheting, braiding, bonding, and/or lacing.

10. The active textile system of claim 1, wherein the first textile filament is interlaced with the second textile filament via knitting, weaving, crocheting, braiding, bonding, and/or lacing.

11. The active textile system of claim 2, wherein the first textile filament is interlaced with the second textile filament via knitting, weaving, crocheting, braiding, bonding, and/or lacing.

12. The active textile system of claim 1, further comprising a vehicle component of a motor vehicle, the vehicle component including a front dashboard, a steering wheel, a fascia panel, a seat assembly, a handle chassis, a center console, and/or a door handle, wherein the textile structure covers at least a portion of the vehicle component.

13. The active textile system of claim 2, further comprising a vehicle component of a motor vehicle, the vehicle component including a front dashboard, a steering wheel, a fascia panel, a seat assembly, a handle chassis, a center console, and/or a door handle, wherein the textile structure covers at least a portion of the vehicle component.

14. The active textile system of claim 4, further comprising a vehicle component of a motor vehicle, the vehicle component including a front dashboard, a steering wheel, a fascia panel, a seat assembly, a handle chassis, a center console, and/or a door handle, wherein the textile structure covers at least a portion of the vehicle component.

15. The active textile system of claim 1, further comprising an electronic controller communicatively connected to the actuating element and configured to control activation of the boundary control actuator to thereby transition the textile structure from the first state to the second state and/or from the second state to the first state.

16. The active textile system of claim 2, further comprising an electronic controller communicatively connected to the actuating element and configured to control activation of the pneumatic and/or hydraulic actuator to thereby transition the textile structure from the first state to the second state and/or from the second state to the first state.

17. The active textile system of claim 4, further comprising an electronic controller communicatively connected to the actuating element and configured to control activation of the vibrational actuator to thereby transition the textile structure from the first state to the second state and/or from the second state to the first state.

18. The active textile system of claim 1, wherein the actuating element transitioning the textile structure from the first state to the second state further causes the textile structure to change dimension, shape, and/or orientation.

19. The active textile system of claim 2, wherein the actuating element transitioning the textile structure from the first state to the second state further causes the textile structure to change dimension, shape, and/or orientation.

20. The active textile system of claim 4, wherein the actuating element transitioning the textile structure from the first state to the second state further causes the textile structure to change dimension, shape, and/or orientation.

* * * * *